US006049919A

United States Patent [19]

Roteman

[11] Patent Number: 6,049,919

[45] Date of Patent: Apr. 18, 2000

[54] SOLAR HEATED PORTABLE SHOWER

[76] Inventor: Gary Roteman, 5822 Corradi Ter., Acton, Calif. 93510

[21] Appl. No.: 09/352,736

[22] Filed: Jul. 14, 1999

[51] Int. Cl.[7] ..... A47K 3/22

[52] U.S. Cl. ..... 4/602; 4/603; 4/616

[58] Field of Search ..... 4/599, 602, 603, 4/616

[56] References Cited

U.S. PATENT DOCUMENTS

| | | | |
|---|---|---|---|
| 3,606,618 | 9/1971 | Veech | 4/603 |
| 3,925,628 | 12/1975 | Kim | 4/599 |
| 4,453,280 | 6/1984 | Greenleaf | 4/599 |
| 5,277,209 | 1/1994 | Olson | 4/602 |
| 5,852,836 | 12/1998 | Montrose | 4/602 |

FOREIGN PATENT DOCUMENTS

| | | | |
|---|---|---|---|
| B-62325/90 | 4/1991 | Australia | 4/616 |
| 3230461 | 2/1984 | Germany | 4/603 |
| 6-54770 | 4/1994 | Japan . | |
| 2180742 | 4/1987 | United Kingdom | 4/616 |

*Primary Examiner*—Charles R. Eloshway
*Attorney, Agent, or Firm*—Dennis W. Beech

[57] ABSTRACT

The solar heated portable shower has a cylindrical container with an open top that has a transparent panel mounted approximately 1½ to 2 inches below the top rim. The container itself is black colored. With water in the container the portable shower is placed in sunlight to allow penetration of sun rays through the transparent panel to be absorbed and provide energy to heat the water. There is a submersible water pump attached to the bottom of the container to pump water through conduit and hose to a spray nozzle. The water pump is connected to an electric energy source such as a battery. When electric power is applied the pump creates water pressure and the spray nozzle valve controls dispensing of water. The portable shower has provision to transport the spray nozzle, hoses and electrical elements as well as an initial quantity of water.

8 Claims, 2 Drawing Sheets

SOLAR HEATED PORTABLE SHOWER

BACKGROUND OF THE INVENTION

1. Field of the Invention

This invention relates to apparatus used by humans for washing when access to fixed shower and wash facilities is not readily available. The new device is a portable powered water supply or shower which is easily transported for use in dispensing heated water for use in washing.

2. Description of Related Art

Various configurations of solar heated showers have previously been disclosed including simple flexible plastic bags designed to heat water therein by exposure to the sun and then to be hung above the user for gravity to provide water flow. More complex apparatus include frame structures for hanging curtain material to provide privacy when using an outdoor shower apparatus. Also portable showers using pumps which may be electric or combustion engine powered have been developed wherein an external pump, using hose or conduit, forces water from a ground level container to the shower head for water dispensing.

In one instance of a complex shower apparatus, that of U.S. Pat. No. 4,453,280, issued on Jun. 12, 1984, the concept of solar heating the water by absorbing sunlight in a black material to be conducted through the material as energy to heat the contained water is disclosed. This apparatus also includes a water pump external to the water in the container portion of the case. Depending on conducted energy through a black wall of a water container has been found not to be very efficient below approximately 90 degrees Fahrenheit environmental temperature.

The present invention provides a simple apparatus which is easy to transport, including an enclosed 5 gallon water supply if desired, and which provides efficient solar heating of the contained water. A powered pump is included in the container and a battery may be attached to the wall of the container. The user may transport the closed container to an outdoor site with charged battery, position the unit in the sun to heat the water, connect the hoses and wiring, start the water pump, and then use the hose nozzle to dispense water as desired.

SUMMARY OF THE INVENTION

One object of the present invention is a portable water dispensing apparatus having a water pump, water storage element and a solar heating means for water stored therein. Another object is the enclosed transport of a quantity of water. A further object is use of a battery which may be transported with the apparatus for powering the water pump. A still further object is dispensing of the water in a shower like manner for washing.

In accordance with the description presented herein, other objectives of this invention will become apparent when the description and drawings are reviewed.

DESCRIPTION OF THE PREFERRED EMBODIMENT

The solar heated portable shower includes a cylindrical container or plastic bucket with an open top. Mounted in the open top below the rim is a transparent plastic circular panel. The side wall of the container is dark colored preferably black. When the container is placed in sunlight the rays of the sun pass through the panel to penetrate water in the container and to be absorbed by the black side wall thus providing energy to heat the water. There is a submersible water pump on the bottom of the container which is in fluid communication with a water spray head and in electrical communication with an electrical energy source. Activating the water pump creates water pressure to the spray head which controls dispensing of water by a valve means.

Figure 1:
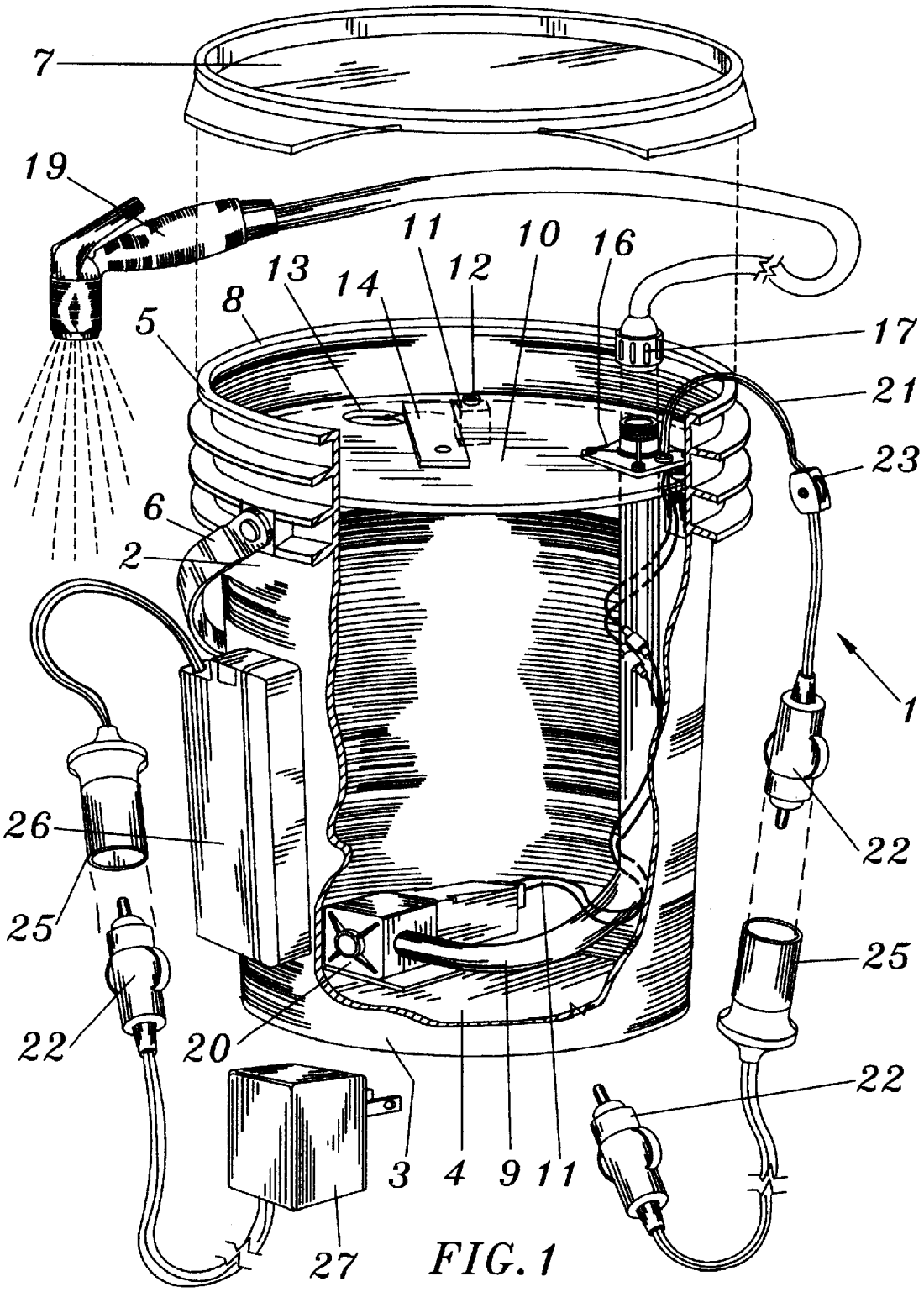
FIG. 1 illustrates a perspective, partial cut away, elevation view of the solar heated portable shower.
Figure 2:
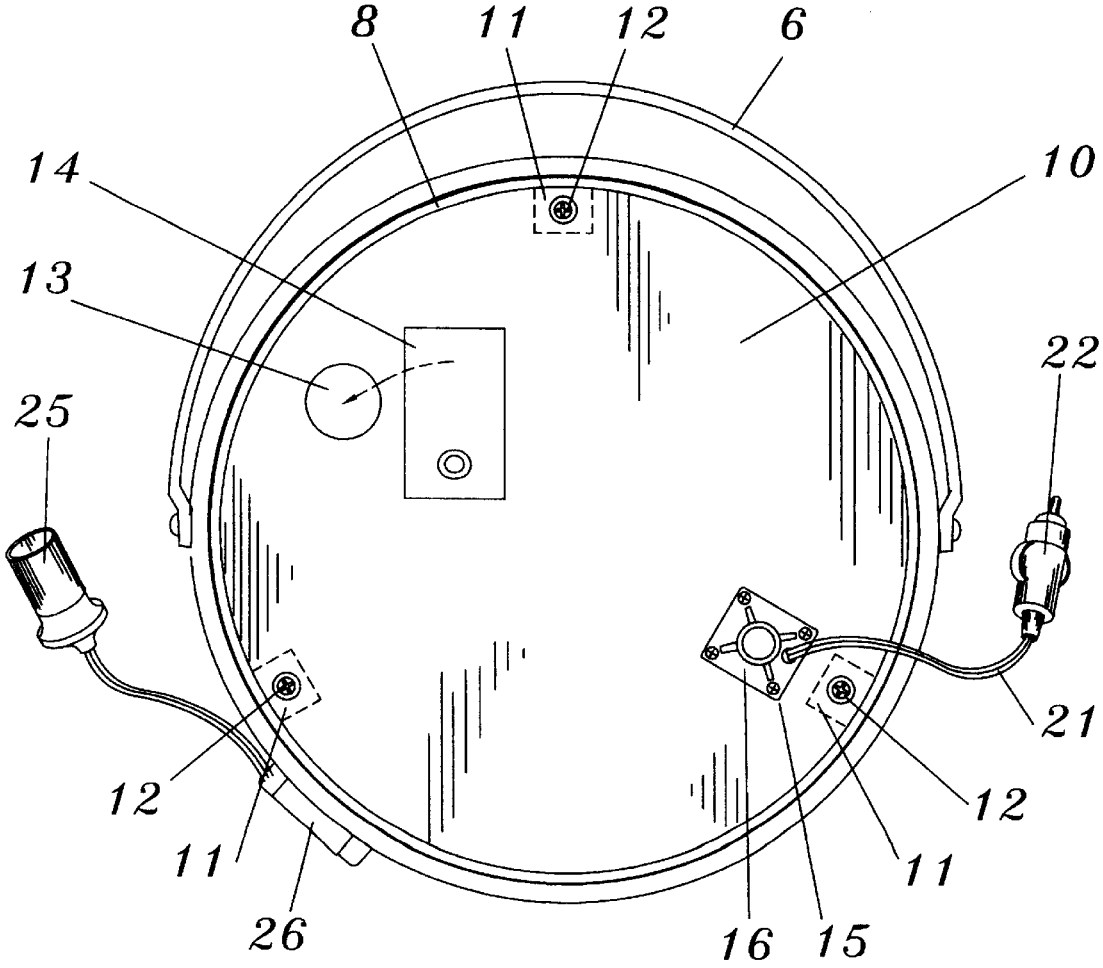
FIG. 2 illustrates a top plan view of the solar heated portable shower.

Referring to FIGS. 1 and 2, the solar heated portable shower (1) preferred embodiment has a cylindrical container (2) with side wall (3), bottom (4) and open top end (5). The container (2) is a plastic material as for example polyvinyl chloride or PVC which is dark, preferable black, in color. A carry handle (6) is attached for ease of transport. There is also a lid (7) formed to fit over rim (8) to enclose and seal the contents of the container (2). While a cylindrical container is described other shapes such as rectangular would also be usable.

At a distance below the top end (5) suitable to allow containment of elements of the shower (1) apparatus, a circular panel (10) of transparent plastic is attached to the side wall (3) interior. Illustrated are wall mounts (11) and screws (12) used to attach the panel (10). In prototypes of the shower (1) it was found that a distance of approximately 1½ to 2 inches from the top end (5) to the panel (10) was suitable.

The panel (10) has a water fill aperture (13) with cover (14) for placing water in the container (2). Obviously a plug of plastic or rubber or other suitable means may be used to close the fill aperture. There is also an outlet aperture (15) having a conduit connector (16) attached thereto. The conduit connector (16) is in fluid communication with a submersible water pump (20) which is attached to the bottom (4) interior to the container (2). Either rigid conduit or flexible hose (9) may be used for this fluid connection.

The conduit connector (16) has a threaded outer wall for attachment of a hose fitting (17) at one end of outlet hose (18). A water spray head (19) is attached at the opposite end of the outlet hose (18) for control of the dispensing of water. In the preferred embodiment a water spray head (19) of the hand grip, squeeze to control valve position type is illustrated.

The water pump (20) is in electrical communication with an electrical power source. Connecting lines (21) penetrate the panel (10) to connect to the water pump (20) and plug (22). In the preferred embodiment the penetration is part of the conduit connector (16) structure. The lines (21) have switch (23) for control of application of electric power. An extension cord (24) with socket (25) and plug (22) is illustrated for use in connection to a remote power source such as an automobile electrical system. The plugs (22) are of the type commonly used for connecting into an automotive cigarette lighter socket.

A portable electric battery (26) is also illustrated attached to the side wall (3) externally. By experiment it has been found that a 12 V dc, 2 amp battery gives reasonable service with commonly available efficient water pumps. The battery (26) has socket (25) which may directly connect to water pump (20) plug (22). Use of an AC converter (27) is also illustrated.

In operation the panel (10) is sealed at its edge against wall (3) by any of the commonly available sealers such as caulk as well as the conduit connector (16) and any penetrations are sealed to avoid water spillage in transport. The elements shown external to the container (2) may be stored on the top of the panel (10) under the lid (7) for a compact transport carry. The battery (26) may be designed for transport as externally attached or internal under the lid (7).

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A portable water holder and dispensing apparatus comprising:

a container having a side wall and a bottom which are dark in color and an open top end forming a rim;

a transparent panel which is removably attached to the side wall interior of the container below the rim;

the panel having a fill aperture with a means for closure thereof and an outlet aperture defined therein;

the outlet aperture having a conduit connector attached thereto which outlet connector is in fluid communication with a water pump attached to the bottom interior to the container and the conduit connector being in fluid communication with a spray head external to the container;

the water pump in electrical communication with an electrical power means; and the container having a means for transporting the apparatus and a lid mountable over the rim, the lid and the panel having sufficient space therebetween to store the spray head, external fluid communication means that provide the fluid communication between the conduit connector and the spray head, and external electrical communication means that provide the electrical communication between the water pump and the electrical power means.

2. The apparatus as in claim 1 wherein the means for transport is a carry handle.

3. The device as in claim 1 wherein the conduit connector having a hose fitting for attachment of an outlet hose thereto the hose being the external fluid communication means.

4. The device as in claim 1 wherein a pair of conductor lines are attached to the water pump and pass through a water sealed access in the conduit connector to be terminated at a plug the plug being the external electrical communication means.

5. The device as in claim 4 wherein there is a switch connected to the pair of conductor lines intermediate the water pump and the plug.

6. The device as in claim 1 wherein the electrical power means is a battery attached to the exterior of the sidewall of the container.

7. The device as in claim 1 wherein the container having a five gallon water storage capacity.

8. The device as in claim 1 wherein the container dark color is black.

* * * * *